US006919105B2

(12) United States Patent
Xue et al.

(10) Patent No.: US 6,919,105 B2
(45) Date of Patent: Jul. 19, 2005

(54) CONTINUOUS PROCESS FOR RETAINING SOLID ADSORBENT PARTICLES ON SHAPED MICRO-CAVITY FIBERS

(75) Inventors: Lixin Luke Xue, Midlothian, VA (US); Kent B. Koller, Chesterfield, VA (US); Qiong Gao, Great Neck, NY (US)

(73) Assignee: Philip Morris USA Inc., Richmond, VA (US)

( * ) Notice: Subject to any disclaimer, the term of this patent is extended or adjusted under 35 U.S.C. 154(b) by 139 days.

(21) Appl. No.: 10/336,951

(22) Filed: Jan. 6, 2003

(65) Prior Publication Data

US 2004/0131770 A1 Jul. 8, 2004

(51) Int. Cl.[7] ..... B05D 1/06; B05D 1/22

(52) U.S. Cl. ..... 427/482; 427/459; 427/475; 427/485

(58) Field of Search ..... 427/459, 475, 427/482, 485, 174, 177, 289, 293, 421, 424; 118/308, 309, 312

(56) References Cited

U.S. PATENT DOCUMENTS 3,682,738 A * 8/1972 Smith ..... 156/283
3,919,437 A * 11/1975 Brown et al. ..... 427/459
4,858,629 A 8/1989 Cundari
5,057,368 A 10/1991 Largman et al.
5,244,614 A 9/1993 Hagen
5,302,419 A * 4/1994 Muzzy ..... 427/485
5,328,736 A * 7/1994 Charles et al. ..... 427/459
5,704,966 A 1/1998 Rohrbach et al.
5,713,971 A 2/1998 Rohrbach et al.
5,744,236 A 4/1998 Rohrbach et al.
5,902,384 A 5/1999 Rohrbach et al.
6,723,378 B2 * 4/2004 Hrubesh et al. ..... 427/180

* cited by examiner

*Primary Examiner*—Fred J. Parker
(74) *Attorney, Agent, or Firm*—Connolly Bove Lodge & Hutz LLP

(57) ABSTRACT

A process of retaining fine adsorbent particles such as carbon material or APS silica gel in the micro-cavities of a shaped fiber comprises the steps of continuously conveying a shaped fiber with micro-cavities to a charging arrangement where the fiber is electrostatically charged. The electrostatically charged fiber is then drawn through a reservoir of the fine adsorbent particles. As the fiber passes through the reservoir the fine particles adhere to the fiber and the micro-cavities thereof. Any excess particles are removed from the fiber outside the reservoir. Subsequently the shaped fiber loaded with fine adsorbent particles is collected for use in filter applications of one type or another such as cigarette filters, for example.

11 Claims, 6 Drawing Sheets

CONTINUOUS PROCESS FOR RETAINING SOLID ADSORBENT PARTICLES ON SHAPED MICRO-CAVITY FIBERS

BACKGROUND OF THE INVENTION

The present invention relates to a process for retaining solid adsorbent particles such as carbon or APS silica gel in the micro-cavities of shaped fibers for subsequent use in filter applications such as cigarette filters that selectively remove or reduce certain components from mainstream tobacco smoke, for example.

Over the years a wide variety of fibrous materials have been employed in tobacco smoke filter elements. Cellulose acetate ("CA") has long been considered the material of choice for this application. However, the choice of materials has been limited because of the need to balance various commercial requirements. A very important property is the filtration efficiency i.e. the ability to selectively remove or reduce certain components from mainstream tobacco smoke.

To achieve appropriate filtration efficiency, materials such as carbon and APS silica gel have been incorporated into cigarette filters. A current method for incorporating adsorbent materials in cigarette filters is the physical entrapment of adsorbent particles between CA fibers. The particle size of materials used is generally limited and in the range of 500 to about 1500 microns in diameter. In order to achieve reasonable product integrity and pressure drop, smaller particles could not be used in this design. In addition, the adsorbents were found to lose activity from exposure to triacetin, a plasticizer used as a binder for the CA fibers.

An improved and more expensive design is to put certain materials such as carbon in the cavity between CA plugs in a Plug/Space/Plug (P/S/P) filter configuration to limit the exposure of adsorbent to the binder. In order to keep the pressure drop through the filter within acceptable limits, coarse granulated materials in the size range of about 10 to about 60 mesh are generally used. A longer shelf life of the adsorbent is achieved, but the efficiency of the filters is limited by the relatively large particle size used. Finer size adsorbent particles with shorter internal diffusive paths and higher effective surface areas cannot be used directly in this configuration due to excessive pressure drop.

Smaller particle size adsorbent materials generally have enhanced kinetics of reaction with gas phase components because of their shorter diffusion paths to the interior surface area of such porous materials and the interior body of such adsorbent materials. It was known that employing smaller adsorbent particles with shorter diffusion paths can form filters with improved kinetics and capacity for gas phase filtration applications.

As explained in application Ser. No. 09/839,669, filed Apr. 20, 2001, and incorporated herein by reference in its entirety for all useful purposes, a fiber with open or semi-open micro-cavities is desirable for holding in place the adsorbent material such as carbon. The term "semi-open cavities" as used herein means cavities that possess openings smaller in dimension than the internal volume of the fiber in which they are formed, and that possess the ability to entrap solid fine particles in their internal volume. The term "open cavities" means the opening is the same or bigger in dimension than the internal volume of the fiber in which they are formed.

SUMMARY OF THE INVENTION

A primary object of the present invention is a continuous process for producing large quantities of shaped micro-cavity fibers with fine solid adsorbent particles such as carbon or APS silica gel on the fibers for subsequent filtration applications.

Another object of the present invention is a continuous process which is simple but highly efficient in adhering fine solid adsorbent particles such as carbon or APS silica gel onto shaped micro-cavity fibers by applying an electrostatic charge to the fibers.

In accordance with the present invention, a continuous process produces large quantities of micro-cavity fibers coated with adsorbent fine particles such as carbon or APS silica gel. The general concept of the process is to expose a continuous shaped fiber to an electrostatic charge and then draw the charged fiber through a reservoir that contains particles suitable for coating the fiber and impregnating into the micro-cavities thereof. Any excess particles on the fiber surface may be removed by vibrating the fiber over a free drawing distance or by exposing the fiber to an impact gas flow. The gas stream to remove the excess particles may be an air stream from a pressured or vacuum source.

In accordance with the present invention, a process of retaining fine adsorbent particles onto and in the micro-cavities of a shaped fiber comprises the steps of continuously conveying such shaped fiber to a charging arrangement where the fiber is electrostatically charged. The charged fiber is then drawn through a reservoir of fine adsorbent particles such as carbon or APS silica gel, for example. The shaped fiber passes through the reservoir thereby producing relative motion between the fiber and the particles, and such relative motion causes the particles to adhere to the micro-cavities of the charged fiber. Any excess particles are removed from the fiber outside the reservoir, and the shaped fiber loaded with the fine adsorbent particles is subsequently collected for use in filter applications such as cigarette filters.

Preferably the step of removing any excess particles from the fiber outside the reservoir includes directing an air stream onto the fiber from a pressurized or vacuum source. The excess particles so removed from the fiber are preferably recycled back to the reservoir. Moreover, the step of collecting the particle laden fiber may include winding the fiber onto a winding wheel thereby producing a generally circular bundle of fibers. Such circular bundle of fibers may be flattened and the end portions of the flattened bundle cut away so that the remaining fibers are aligned with one another in a particularly useful form for filter applications.

The charged fiber may be repeatedly passed through the reservoir to increase the amount of adsorbent particles adhering to the fiber. Also, it is preferred that the fiber be drawn through the reservoir of fine adsorbent particles at a speed in the range of 5 to 15 m/min, preferably 10 m/min.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
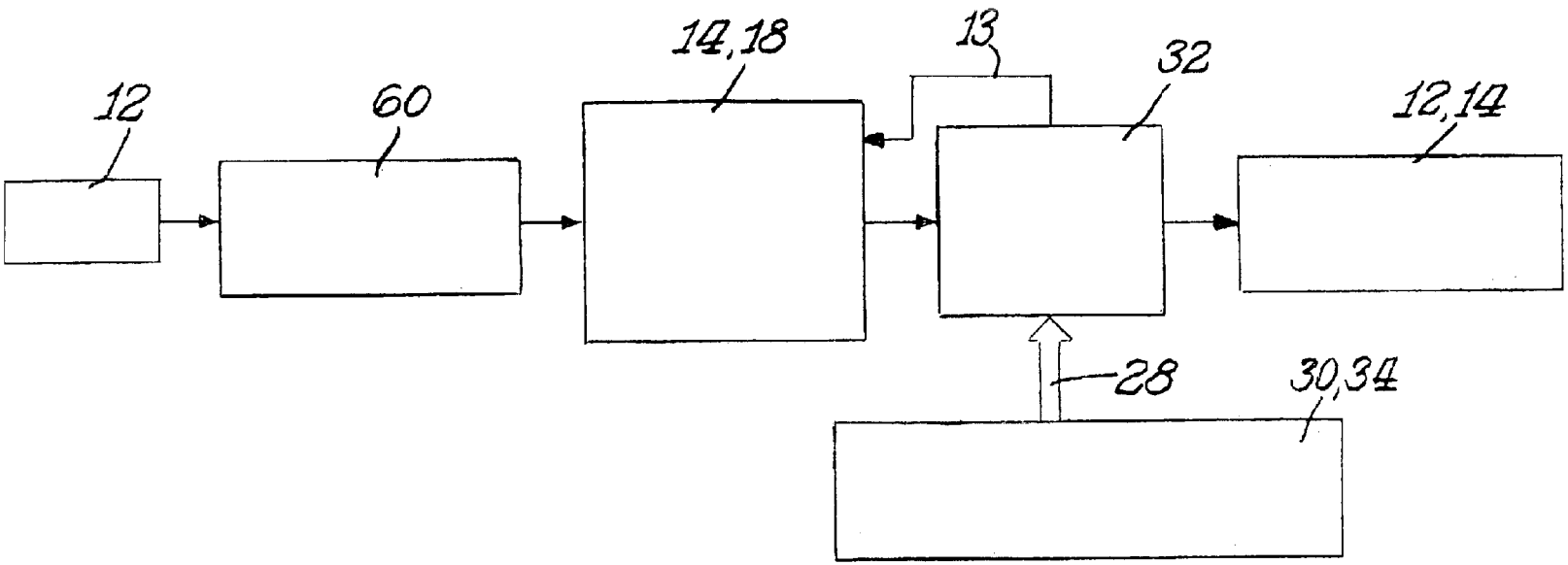
FIG. 1 is a flow diagram illustrating the process of the present invention.

Referring in more particularity to the drawings, FIG. 1 is a diagrammatic flow chart illustrating the general concept of the present invention. Starting at the left of FIG. 1 and moving to the right, shaped fibers 12 are conveyed to an electrostatic charging device 60 where the fibers are electrostatically charged. The charged fibers are then drawn through a reservoir 18 of fine particles 14 such as carbon or APS silica gel where the particles are attached onto and into micro-cavities of the charged fibers.

Upon exit of the particle laden fibers from the reservoir any excess particles may be removed by directing an air stream 28 onto the fibers from a pressurized or vacuum source 30, 32. Mechanical vibration 34 may also be used for this purpose. The removed excess particles may be recycled via line 13. Ultimately, the particle laden fibers 12, 14 are collected and subsequently processed for use in filter applications such as cigarette filters.

Shaped fibers with micro-cavities are described in U.S. Pat. No. 5,057,368 which is incorporated by reference in its entirety for all useful purposes. This patent describes shaped micro-cavity fibers that are multilobal such as trilobal or quadrilobal. Other US patents which describe shaped micro-cavity fibers include U.S. Pat. Nos. 5,902,384; 5,744,236; 5,704,966 and 5,713,971, each of which is incorporated by reference in its entirety including the drawings thereof. In addition, U.S. Pat. Nos. 5,244,614 and 4,858,629 specifically disclose multilobal fibers, and these patents are incorporated by reference in their entirety for all useful purposes.

Suitable fine particles 14 include, but are not limited to, carbons, aluminas, silicates, molecular sieves, zeolites, and metal particles. The carbon used can be, but is not limited to, wood based, coal based or coconut shell based or derived from any other carbonaceous material such as petroleum pitch. Optionally, the material may be treated with desired chemical reagents, so as to modify the particle surfaces to include a particular functional group or functional structure. Coconut shell carbon powder available from Pica and a powdered Amino Propyl Silyl (APS) Silica Gel are particle examples. Carbon in spherical beaded form may also be utilized.

Figure 2:
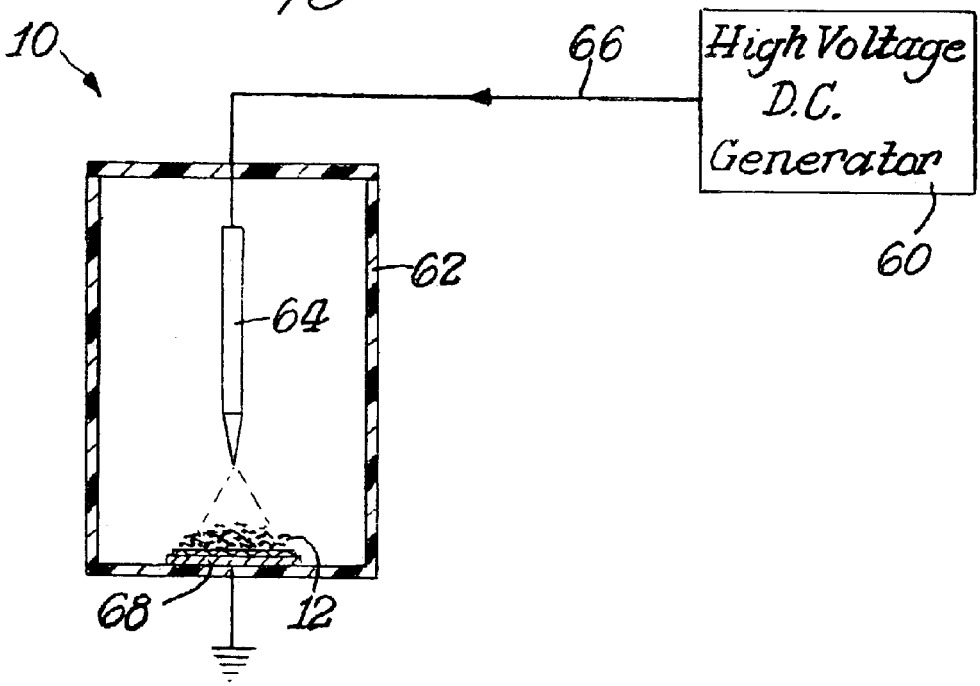
FIG. 2 is a schematic diagrammatic view illustrating a corona discharge device for electrostatically charging shaped fibers and thereby enhancing the retention of fine solid particles onto and in the micro-cavities of the shaped fibers, according to the present invention.

FIG. 2 of the drawings shows a system 10 for electrostatically charging shaped fibers 12 to increase fine particle retention of the fibers. The charging procedure may comprise tribo-electrification charging, corona charging, electron or ion beam charging, radiation charging, etc. In system 10 the fibers 12 are statically charged using a corona discharge Spellman SL-30 high-voltage-generator 60 to provide the desired discharge voltage. System 10 also includes a thermoplastic enclosure 62 and a corona tungsten tip 64 within the enclosure is connected to the high voltage D.C. generator 60 via line 66. Fibers 12 are positioned on a copper ground plate 68. The operation may be batch or continuous with the fibers moving past the charging element. FIG. 2 shows a batch operation where a bundle of fibers are electrostatically charged for about 10 to 30 minutes. With continuous operation and a single fiber, charging time is much less and on the order of a few seconds.

The charging voltage may be between 24 kV and 30 kV while the distance from the corona tip 64 to ground copper electrode plate 68 may be about 28 mm. This is high enough to produce corona without breakdown. A sample mat of fibers 12 is laid on top of the copper ground plate. The fiber sample is charged at room temperature for varying periods depending on the sample size and particle being used.

The retention capacity for APS silica gel powder in a micro-cavity fiber at various exposure times is summarized in Table 1 below.

TABLE 1

Retention of APS Powder With Varying Exposure Times

| Example/ref. | Fiber Initial Weight mg | Charging time/Min. | APS Loaded Weight mg | Particle Retention % |
|---|---|---|---|---|
| 1/50-1 | 246.73 | 0 | 332.32 | 34.7 |
| 2/50-7 | 275.69 | 5 | 424.29 | 53.9 |
| 3/50-8 | 253.94 | 10 | 406.41 | 60.0 |
| 4/50-6 | 278.65 | 30 | 464.72 | 66.8 |
| 5/50-3 | 287.82 | 180 | 501.65 | 74.3 |

The particle retention percentage is calculated by subtracting the initial weight of the fiber from the weight of the fiber loaded with APS silica gel, dividing by the initial weight of the fiber and multiplying by 100.

From the results shown in Table 1, it is clear that the retention capability of the fiber used (4-DG PP Fiber DPL-283) for APS powder was greatly enhanced by charging the fiber mat. Longer charging time produces increased static charge, and more charge produces higher particle retention. However, saturation occurs after 30 minutes charging time. The 4-DP PP Fiber DPL-283 is a deep groove polypropylene fiber available from Fiber Innovative Technologies. This fiber will be referred to hereafter as 4-DG PP.

Figure 3:
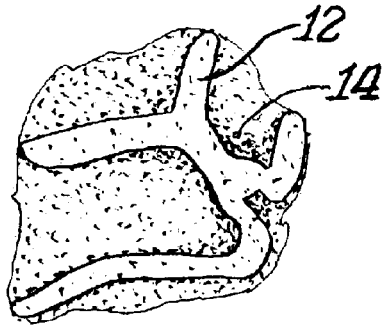
FIG. 3 is a diagrammatic perspective view of a shaped fiber with the micro-cavities thereof coated with adsorbent particles, according to the present invention.

The diagrammatic perspective view of a charged micro-cavity fiber retaining solid particles 14 is shown in FIG. 3. The charged fiber 12 retains a greater quantity of APS silica gel or carbon by using all the internal void volume by electric attraction. Due to the strong association of these fine particles with the fiber lobes, their distribution in a filtration device may be controlled by the distribution of the fibers, so their high surface area may be well oriented for filtration application without imposing a high-pressure drop to the filter system.

Figures 4A, 4B, 4C:
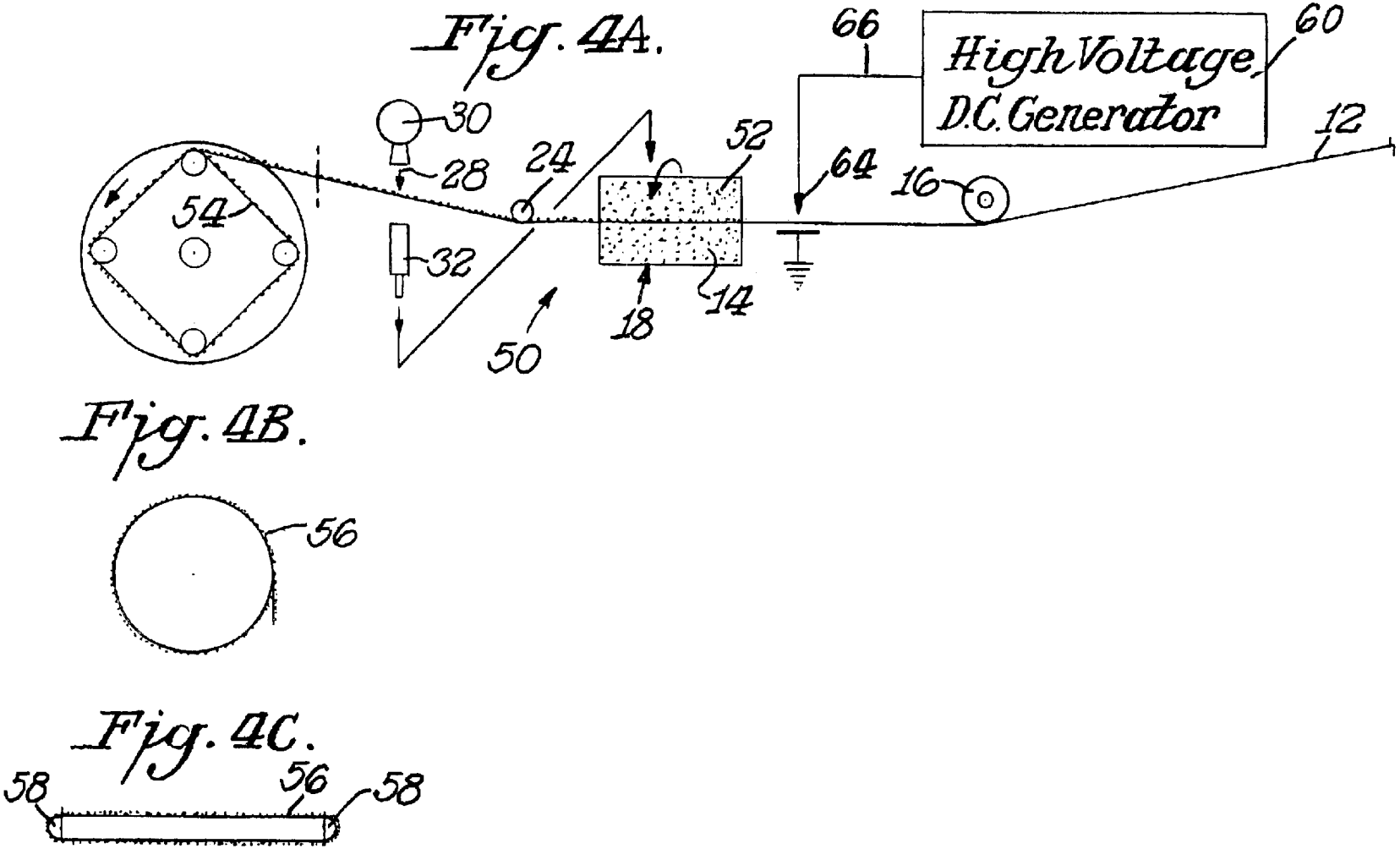
FIG. 4A is a schematic diagrammatic view illustrating a process of adhering fine adsorbent particles onto a shaped fiber including collection of the coated fibers on a winding wheel, according to the present invention.
FIG. 4B shows a bundle of particle laden fibers removed from the winding wheel of FIG. 4A.
FIG. 4C shows the bundle of particle laden fibers removed from the winding wheel of FIG. 4A, flattened and about to be cut at the ends thereof along the cut lines shown in phantom outline.

FIG. 4A shows a continuous system 50 for coating shaped fibers 12 with a carbon material 14. A fiber 12 is conveyed over guide roller 16 to a corona discharge arrangement comprising high voltage D.C. generator 60, corona tip 64, line 66 and cooper electrode plate 66. The fiber is statically charged and then drawn through a reservoir 18 of carbon material 14 in the form of a rotating drum 52. As the charged fiber passes through the drum of carbon material, carbon adheres to the fiber and into the micro-cavities thereof. Upon exiting the drum 52, any excess carbon is removed from the fibers by directing an air stream 28 onto the fibers. Alternatively, or in combination with the air stream 28, the fiber may be vibrated to remove any excess particles. Preferably any removed excess is recycled back to the reservoir. The adsorbent particle size is in the range of about one to about 50 micrometers.

The shaped fibers laden with carbon may be directly transported to a plug maker (not shown) for producing cigarette filter plugs for attachment to tobacco rods in the manufacturing of cigarettes. Alternatively, as shown in FIG. 4A, the carbon laden fibers may be collected on a large winding wheel 54 driven by a suitable motor (not shown). This driven winding wheel also functions to draw the charged fibers 12 through the reservoir 18. After collecting a number of turns of carbon laden fibers on the winding wheel 54, the fibers are removed from the winding wheel in the form of a circular bundle of fibers 56, as shown in FIG. 4B. The circular bundle is subsequently flattened to the form diagrammatically shown in FIG. 4C, and the ends 58 of the flattened bundle are cut away thereby leaving a bundle of aligned impregnated fibers. These aligned fibers are then utilized in any desired filter application, such as cigarette filters. The size of the bundle may be controlled by controlling the number of turns of fiber on the winding wheel.

Figure 5:
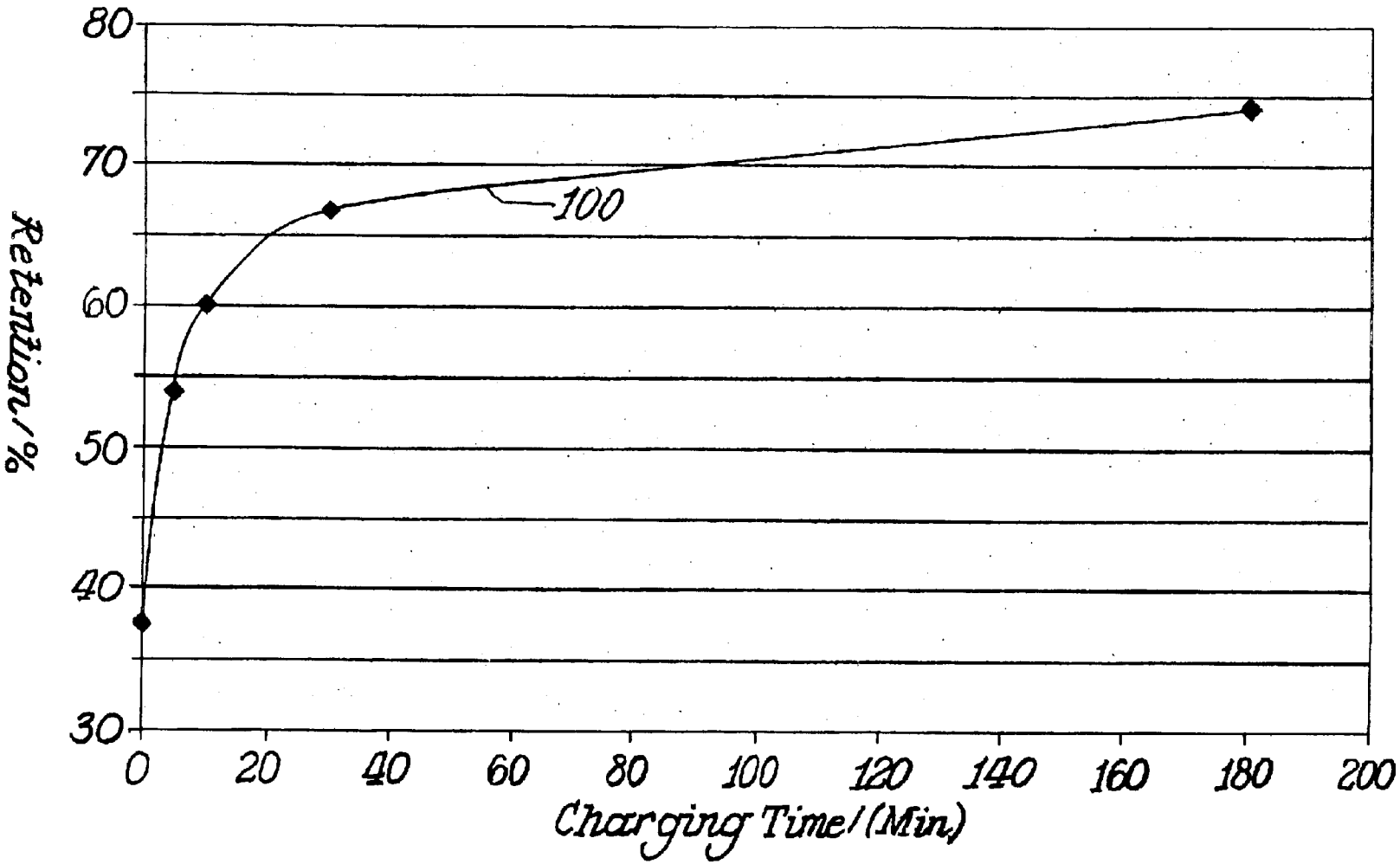
FIG. 5 is a graph of carbon retention percentage on a shaped fiber versus the electrostatic charging time of the shaped fiber.

FIG. 5 shows a curve 100 of carbon retention percentage on the shaped fibers versus charging time. This plot is for batch charging of a bundle of fibers as shown in FIG. 2. When the operation is continuous involving a single fiber much shorter charging times are required normally on the order of a few seconds at most.

Figure 6:
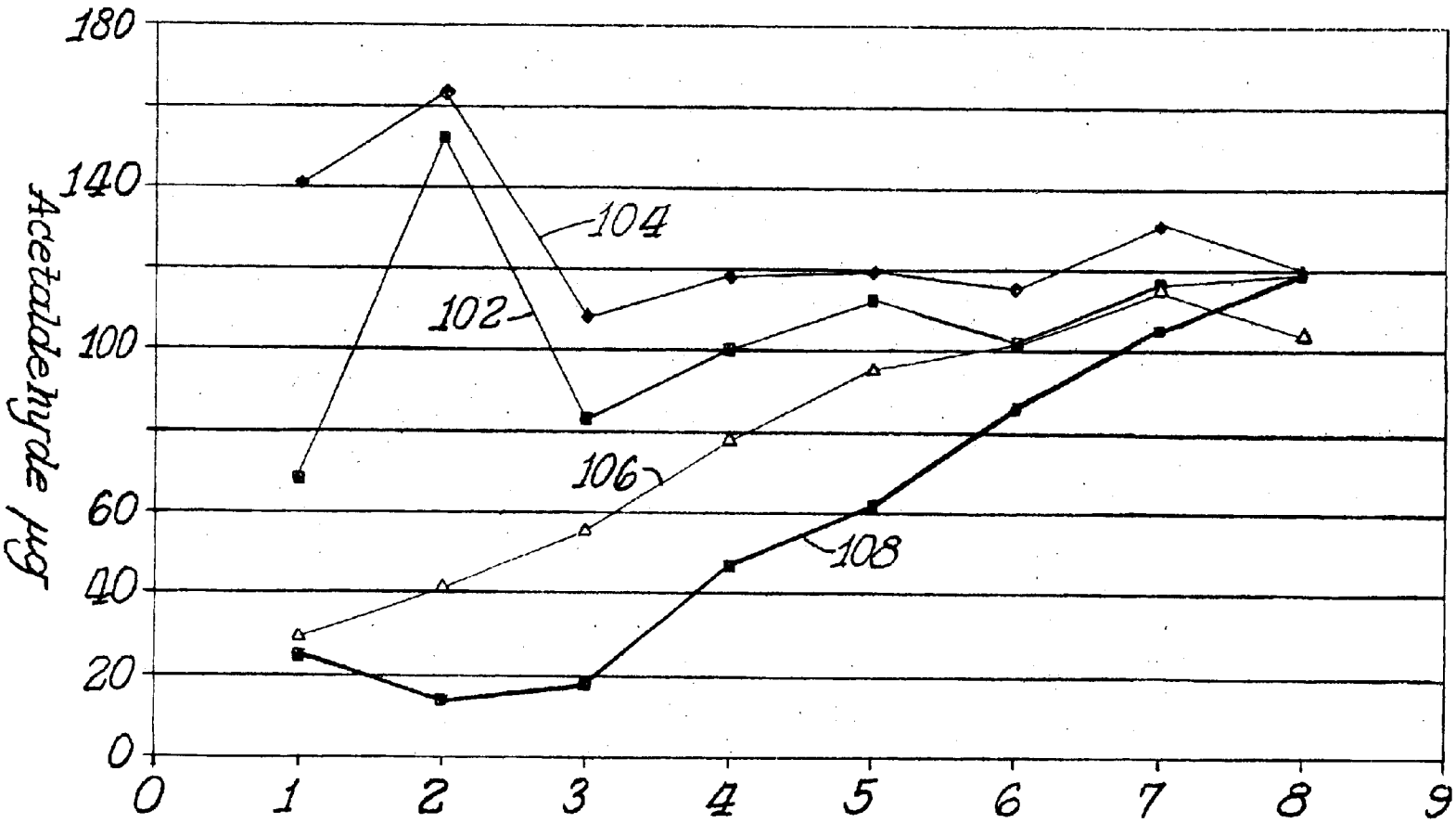
FIG. 6 is a graph of puff-by-puff comparison of fiber filter performance on acetaldehyde delivery.

FIG. 6 is a graph of puff-by-puff comparison of the performance of various filter constructions on acetaldehyde delivery in tobacco smoke. Curve 102 shows the delivery of a standard IR4F reference cigarette which primarily comprises a tobacco rod and a cellulose acetate filter. The remaining curves illustrate the delivery performance of other cigarette configurations. Curve 104 shows the performance of a cigarette having a filter constructed of 4-DG PP fiber without any particulate loading. The acetaldehyde delivery is slightly higher across all puffs. Curves 106 and 108 show the greatly reduced delivery of cigarette filters with 4-DG PP micro-cavity fiber loaded with APS silica gel and carbon, respectively. Loading was done after the fiber was electrostatically charged.

Figure 7:
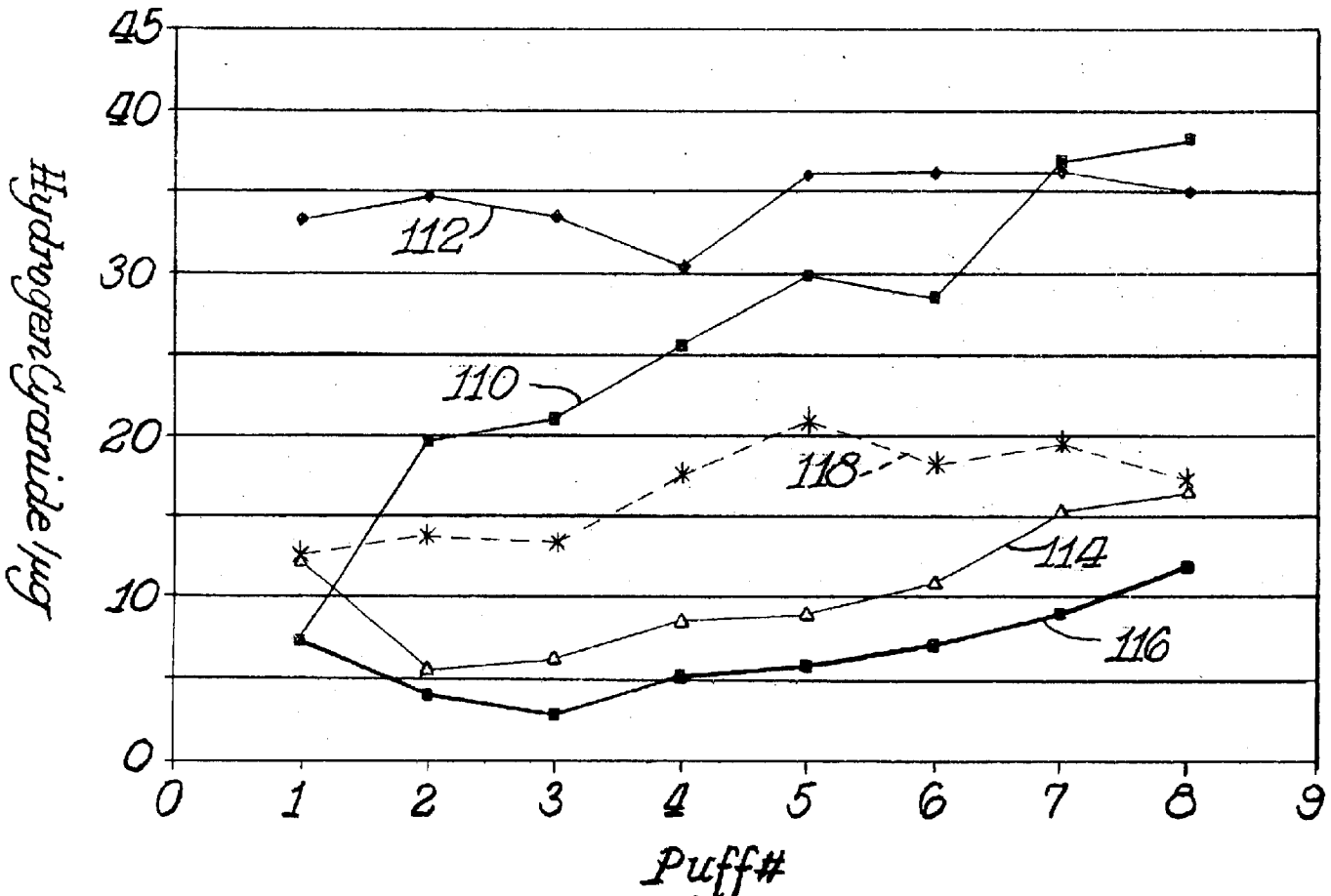
FIG. 7 is a graph of puff-by-puff comparison of fiber filter performance on hydrogen cyanide delivery.

FIG. 7 is similar to FIG. 6 except that the puff-by-puff comparison of the performance-various filter constructions is on hydrogen cyanide delivery in tobacco smoke.

Curve 110 shows the delivery of a standard IR4F reference cigarette a while the remaining curves illustrate the delivery performance of other cigarette constructions. Curve 112 shows the performance of a cigarette having a filter constructed of 4-DG PP fiber without any particulate loading. The hydrogen cyanide delivery is slightly higher across all puffs. Curves 114 and 116 show the greatly reduced delivery of cigarette filters constructed with 4-DG PP micro-cavity fiber loaded with APS silica gel and carbon, respectively. Loading was done after the fiber was electrostatically charged.

FIG. 7 also includes curve 118 for a cigarette having a filter constructed with 4-DG PP micro-cavity fiber loaded with APS silica gel. The only difference between the filter of curve 118 and the filter of curve 114 is that filter of curve 118 was loaded with APS silica gel without the fiber being electrostatically charged before loading. The hydrogen cyanide delivery is slightly higher in curve 118 because less APS silica gel is loaded into the fiber when no electrostatic charge is initially applied before loading.

It should be understood that the above detailed description while indicating preferred embodiments of the invention are given by way of illustration only since various changes and modifications within the spirit and scope of the invention will become apparent to those skilled in the art from the detailed description. For example, other shaped fibers with micro-cavities may be loaded with adsorbent material after initially being electrostatically charged.

What is claimed is:

1. A process of retaining fine adsorbent particles in the cavities of shaped fibers comprising the steps of:

continuously conveying a shaped fiber with cavities to a charging arrangement where the fiber is statically charged;

conveying the charged fiber through a reservoir of fine adsorbent particles having a size in the range of about 1 to about 50 micrometers where the particles adhere to the cavities of the fiber and retain their particle form;

removing any excess particles from the particle coated fiber outside the reservoir; and collecting the shaped fiber laden with the fine adsorbent particles and with the particles retaining their particle form.

2. A process of retaining fine adsorbent particles in the cavities of shaped fibers as in claim 1, wherein the reservoir of fine adsorbent particles comprises APS silica gel powder.

3. A process of retaining fine adsorbent particles in the cavities of shaped fibers as in claim 1, wherein the reservoir of fine adsorbent particles comprises carbon material.

4. A process for retaining fine adsorbent particles in the cavities of shaped fibers as in claim 3, wherein the carbon material is granular material.

5. A process of retaining fine adsorbent particles in the cavities of shaped fibers as in claim 3, wherein the carbon material is spherical bead material.

6. A process of retaining fine adsorbent particles in the cavities of shaped fibers as in claim 1, wherein the step of removing any excess particles from the particle coated fiber outside the reservoir includes directing an air stream onto the particle coated fiber from a pressurized or vacuum source.

7. A process of retaining fine adsorbent particles in the cavities of shaped fibers as in claim 1, wherein the step of removing any excess particles from the particle coated fiber outside the reservoir includes vibrating the particle coated fiber.

8. A process of retaining fine adsorbent particles in the cavities of shaped fibers as in claim 1, wherein the step of collecting the shaped fiber laden with the fine adsorbent particles includes winding the fiber onto a winding wheel to produce a bundle of fibers.

9. A process of retaining fine adsorbent particles in the cavities of shaped fibers as in claim 8 further including the steps of:

removing the bundle of fibers from the winding wheel;

flattening the bundle to produce a flattened bundle with opposite end portions; and cutting away the end portions of the flattened bundle whereby the remaining fibers are aligned with one another.

10. A process of retaining fine adsorbent particles in the cavities of shaped fibers as in claim 1, wherein the step of passing the shaped fiber through the reservoir of fine adsorbent particles includes pulling the fiber through the reservoir.

11. A process of retaining fine adsorbent particles in the cavities of shaped fibers as in claim 1 further including the step of:

recycling any excess particles removed from the particle coated fiber back to the reservoir.

* * * * *